United States Patent [19]

Wilhelm

[11] Patent Number: 4,833,970

[45] Date of Patent: May 30, 1989

[54] SUBMACHINE GUN

[76] Inventor: Gary Wilhelm, 55 Kelly Rd., Hamden, Conn. 06514

[21] Appl. No.: 91,035

[22] Filed: Aug. 31, 1987

[51] Int. Cl.[4] ..... F41D 11/02

[52] U.S. Cl. ..... 89/141; 89/142

[58] Field of Search ..... 89/141, 142

[56] References Cited

U.S. PATENT DOCUMENTS

| | | | |
|---|---|---|---|
| 858,745 | 7/1907 | McClean | 89/142 |
| 2,342,824 | 2/1944 | Swebilius | 89/142 |
| 2,437,548 | 3/1948 | Patchett | 89/194 |
| 3,012,479 | 12/1961 | Ruffell | 89/142 |
| 3,200,709 | 8/1965 | Montana | 89/142 |
| 4,523,510 | 6/1985 | Wilhelm | 89/142 |

*Primary Examiner*—Stephen C. Bentley
*Attorney, Agent, or Firm*—William W. Jones

[57] ABSTRACT

The sub machine gun fires single shots in semi automatic fashion, and also fires fully automatically, with the firing mode being manually selectable. The firing mode selection also includes a safe setting, and there is a grip safety which renders the gun inoperative unless the pistol grip is squeezed. The safeties are configured and balanced so that the gun will not fire if dropped. There is one manually operable latch that allows complete take down of the action. When the receiver cover is lifted with the bolt cocked, the bolt will not accidentally move forward to fire the gun. The slide actuator holds the receiver cover in its open position. The barrel is latched in place by a latch pin that cannot unintentionally be removed from the gun and misplaced. The barrel latch pin can be partially withdrawn to allow removal of the barrel from the receiver. The sear, through interaction of the grip safety, also prevents the bolt, if in the fired position, from reaching the cocked position if the gun is accidentally dropped. This prevents the gun from accidentally being fired.

8 Claims, 12 Drawing Sheets

SUBMACHINE GUN

This invention relates to a sub machine gun which has improved safety features, and which has two firing modes: semi-automatic; and full automatic. The gun also embodies additional safety, simplicity and convenience.

Sub machine guns which have multiple firing modes are well known in the prior art. These guns typically will have a manually operated selector which, when manipulated, changes the firing mode of the gun from fully automatic, to semi-automatic, and the like. These guns may also typically include an automatic safety on the pistol grip which prevents firing of the gun in any mode unless the grip is squeezed. In addition to the automatic grip safety, a manual safety may be included. This will be manually operable lever or pin which, in one position renders the gun safe, and in another position renders the gun operable. The aforesaid features in the prior art sub machine guns are sometimes complicated and are often prone to unintentional malfunctions. For example, guns with a grip safety may fire even when the grip is not being squeezed, as, for example, if the guns were dropped. Another problem which occurs in guns with grip safeties arises from vibration when the gun is fired. When the gun is fired in an automatic mode, the grip will vibrate in one's hand. This vibration can cause the grip safety to lock the action so that the gun will suddenly stop firing. In addition to the aforesaid safety problems, the prior art sub machine guns of the character described are generally too complicated and expensive.

The sub machine gun of this invention is more simple in construction than similar prior art sub machine guns, has an improved and simplified integrated manual safety/firing mode selector, and also has an improved automatic grip safety. The grip safety is constructed of pivoting components which are pivotally neutral, i.e., the center of gravity of each component is coincidental with the pivotal axis thereof. This ensures that the safety components will not have any tendency to pivot out of their respective operative positions. The manual safety/selector is a member which rotates about its axis of symmetry and which is detented in each of its selecting positions so that it will not rotate out of its selected position if the gun is dropped. The grip safety and the trigger have an interlocking relationship when the gun is being fired so that vibrations which occur during firing will not disrupt the fact that the grip safety and trigger were squeezed when firing of the gun began. The gun operates with a blow-back action actuated by the cartridge case being forced against the face of the bolt when the gun is fired. The bolt is spring biased in the breech-closed direction and is contained in a receiver which has a pivoting cover. A cocking slide is also included so that the bolt can be moved to the breech-open or cocked position manually. Provision is made for holding the bolt in the cocked position if the receiver cover is pivoted to its open position while the bolt is cocked so that the gun will not fire if the receiver cover is opened for some reason when the bolt is cocked. Anytime that the receiver cover is pivoted to its open position, the cocking slide, which is biased in a muzzleward direction, will hold the cover open. To disassemble the gun, there is a single latch which holds the receiver cover closed. That latch can be manually released to allow the receiver cover to be pivoted to its open position. When the receiver cover is in its upward open position, the bolt can be manually lifted out of the receiver after the bolt spring is depressed. Once the receiver cover is pivoted to its open position, a barrel retention pin can be partially retracted from the gun to allow the barrel to be removed from the receiver. The gun also features a floating cartridge case ejector which displays superior operational efficiency and is of simple construction. Since it is not permanently fastened to any part of the gun by a pin, screw, rivet, or welding, it can be easily removed or replaced in seconds. The gun has an adjustable shoulder stock which is lightweight and sturdy, and which can be moved to a retracted position when the gun is used as a machine pistol, or to an extended position when the gun is used as a shoulder arm. If desired, the shoulder stock can be removed from the gun in a few seconds.

It is therefore an object of this invention to provide a multi phas sub machine gun which incorporates improved safety features with substantially simplified construction.

It is an additional object of this invention to provide a sub machine gun of the character described which has a manually operable safety/selector member and a grip safety assembly, the latter of which requires that the grip be squeezed to allow firing.

It is a further object of this invention to provide a sub machine gun of the character described wherein the safety/selector and the grip safety are pivotally neutral so that, unless intentionally pivoted, they will not move pivotally when subjected to random forces, as when the gun is dropped.

It is another object of this invention to provide a sub machine gun of the character described wherein the bolt will be retained in a cocked position, if cocked, when the receiver cover is opened.

It is yet another object of this invention to provide a sub machine gun of the character described having a single latch which locks the receiver cover in a closed position and which, when manipulated, allows the receiver cover to be moved to its open position to allow removal of the bolt from the receiver.

It is still another object of this invention to provide a sub machine gun of the character described which includes a lock pin which secures the barrel to the receiver and can only be neutralized when the receiver cover is moved to its open position.

These and other objects and advantages of the invention will be more fully appreciated from the following detailed description of a preferred embodiment of the invention when taken in conjunction with the accompanying drawings, to which:

Figures 1, 2:
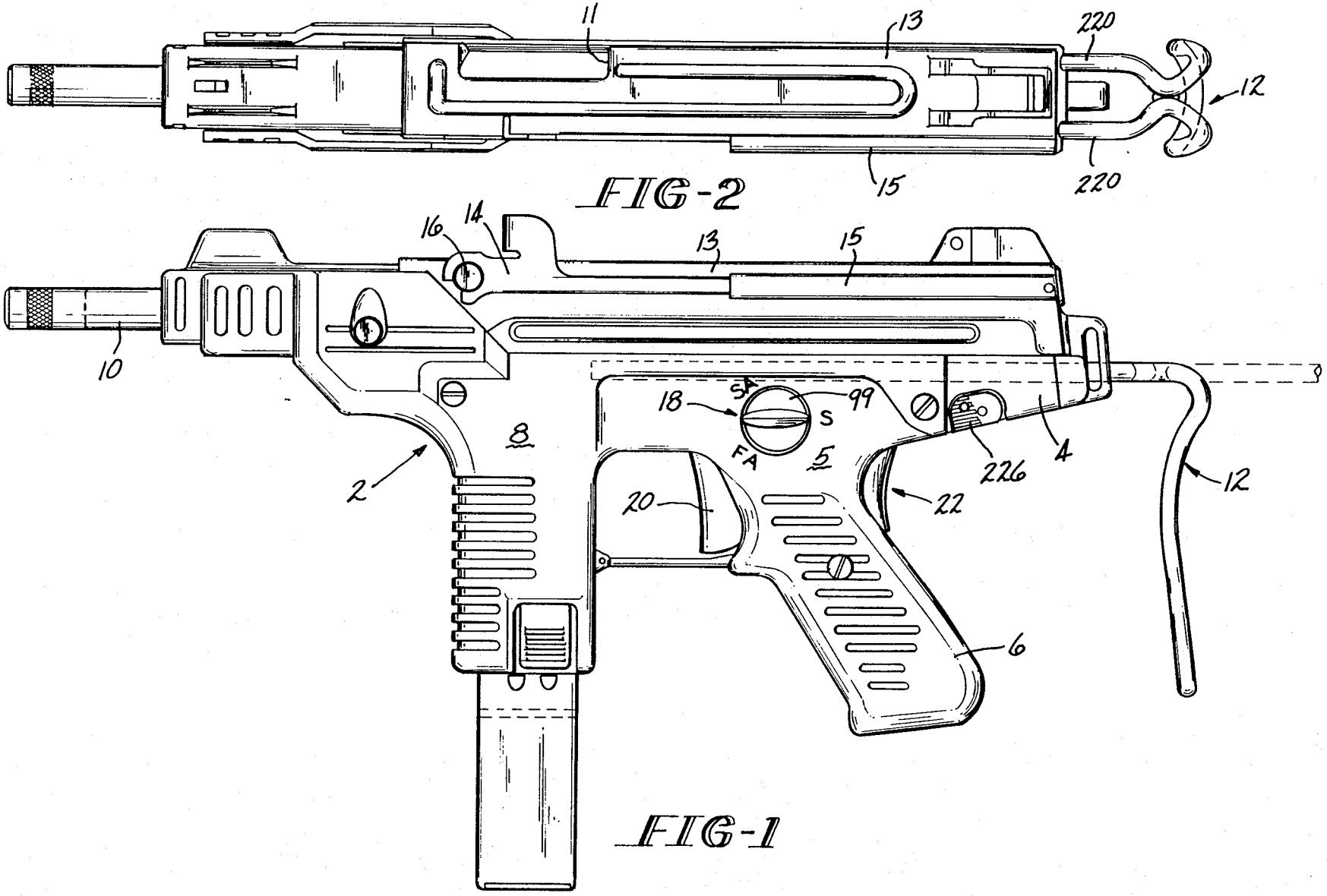
FIG. 1 is an elevational view of the left side of a preferred embodiment of a sub machine gun formed in accordance with this invention.
FIG. 2 is a plan view of the top of the gun.

Referring now to the drawings, there is shown in FIGS. 1 and 2, a preferred embodiment of a sub machine gun formed in accordance with this invention. The gun, denoted generally by the numeral 2, includes a receiver housing 4, a trigger housing 5 with a pistol grip 6, and a magazine housing 8. The barrel 10 is removably mounted in the muzzleward end of the receiver housing 4. An adjustable shoulder stock 12 having side arms 220 is mounted in the breechward end of the receiver housing 4. A receiver cover 13 is pivotally disposed on the receiver housing 4, the cover 13 having a cartridge ejection port 11 formed therein. A cocking slide 14 is reciprocally movably mounted in a pocket 15 on the receiver cover 13, the slide 14 being connected to the cover 13 by a pin 16. A manual safety/selector member 18 is rotatably mounted in the trigger housing 5 and is accessible from both sides of the trigger housing 5 so that it can be operated with either hand. A trigger 20 is mounted in the trigger housing 5, as is a grip safety, designated generally by the numeral 22.

Figure 3:
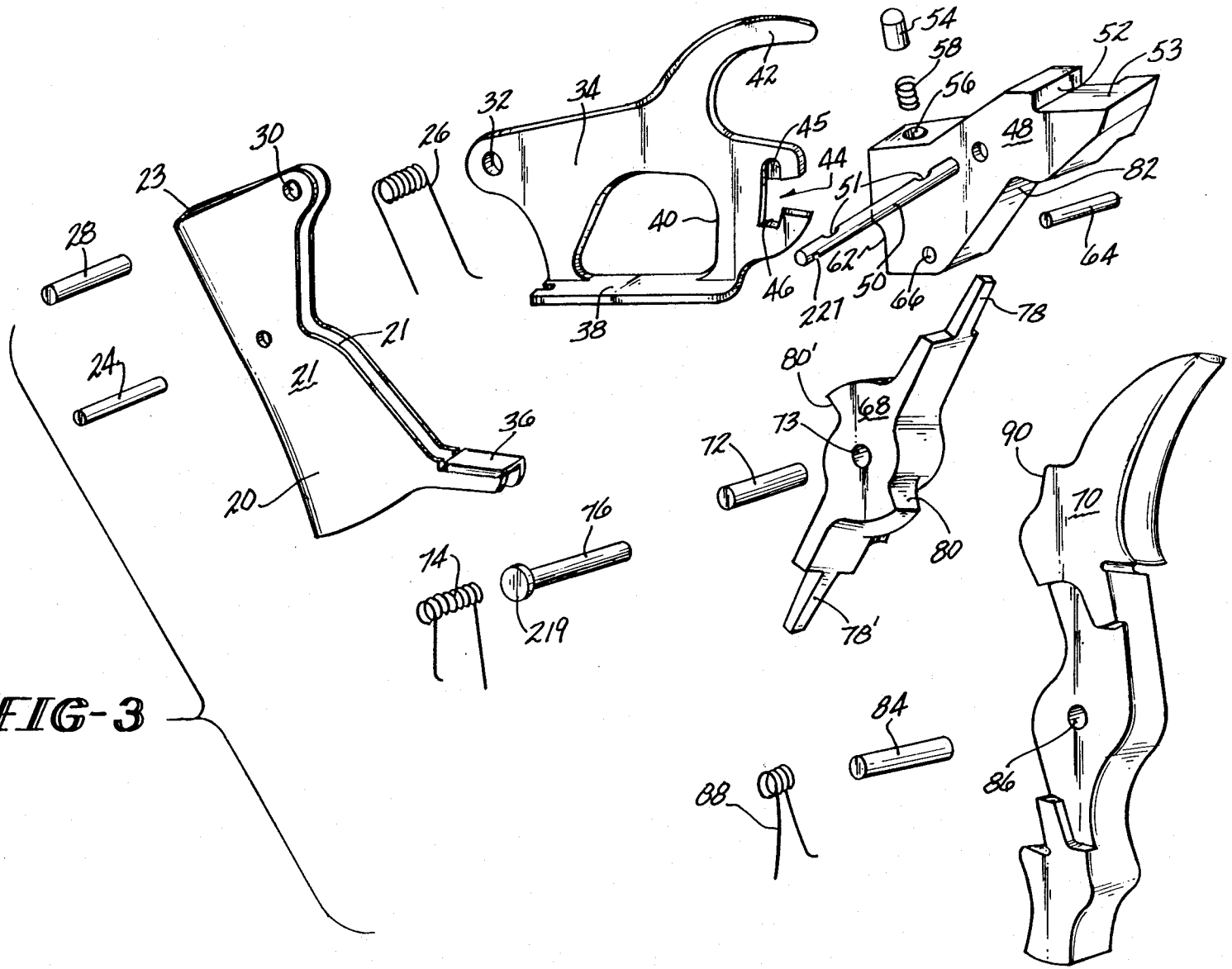
FIG. 3 is an exploded perspective view of the firing mechanism of the gun.

Referring now to FIG. 3, there is shown the component parts of the firing mechanism of the gun 2. The trigger 20 pivots in the receiver about a pin 24 and is biased by a torsion spring 26 which is mounted on a pin 28 disposed in aperture 30 on the trigger 20. The pin 28 also extends through an aperture 32 in a connector member 34 and the spring 26 also biases the connector 34. The trigger 20 is formed from a U-shaped piece of sheet metal having opposed sides 21 and a connecting web 23, which is the part of the trigger 20 which one's finger engages when the gun is fired. The trigger 20 includes a bridge part 36 which extends between the sides 21, the purpose of which will be detailed hereinafter. The connector 34 is formed with a bridge portion 38, which the spring 26 engages, and a central window area 40. The connector 34 also includes a curved bolt-engaging finger 42 and a sear pin notch 44 which has a steps 45 and 46 formed therein.

The sear 48 is pivotally mounted in the receiver on a pin 50 and includes a shoulder 52 which engages the bolt in the gun, and also includes a lip 53 which engages the floor of the receiver housing 4, as will be set forth in greater detail hereinafter. The pin 50 includes a pair of semi-circular cuts 51 through which the arms 220 of the shoulder stock 12 pass. The sear 48 is biased about the pin 50 by a button 54 disposed in a well 56 in the sear 48. A coil spring 58 is also disposed in the well 56 to bias the button 54 against an overlying surface 60 in the floor of the receiver 4. The sear 48 includes a safety stop surface 62 formed thereon. Mounted on the sear 48 is a sear/-connector pin 64 disposed in a bore 66 in the sear.

The grip safety 22 includes two pivotable parts, the first of which is a lock member 68 and the second of which is an actuator 70. The actuator 70 is the part which is visible in FIG. 1 and will be engaged by the web of the hand (between the thumb and fingers) when the pistol grip is grasped to fire the gun. The lock 68 is pivotally mounted on a pin 72 and is biased in a counter clockwise direction about the pin 72 by a torsion spring 74 which, in turn, is mounted on its own pin 76. The lock pin 72 extends through a bore 73 which passes through the center of gravity of the lock 68 so that random forces which may be imposed upon the lock 68 will not tend to cause the lock 68 to pivot about the pin 72. Since the lock 68 has no inherent inertail tendencies, it will not tend to pivot out of its locking position were the gun to be dropped. It will also be noted that the lock 68 is symmetrical about the axis of the aperture 73 so that its orientation in the receiver when mounted on the pin 72 is irrelevant. Thus the lock 68 cannot be assembled in the receiver in a "backwards" position. The lock 68 has two sear-engaging fingers 78 and 78′ and two shoulders 80 and 80′. The fingers 78,78′ engage a recess 82 on the sear 48, and the shoulders 80, 80′ engage the actuator 70 in a manner described with more clarity hereinafter. The actuator 70 is pivotally mounted on a pin 84 disposed in a bore 86. The pin 84 also carries a torsion spring 88 which biases the actuator 70 in the clockwise direction about the pin 84. The actuator 70 is pivotally neutral about the pin 84 since its center of gravity corresponds to the axis of the bore 86. This is accomplished by increasing the mass of the portion of the actuator 70 which is disposed below the bore 86, as viewed in FIG. 3. Thus the actuator 70 will not tend to pivot about the pin 84 if the gun is dropped or otherwise jostled. Looking at FIG. 1 it will also be readily apparent that the exposed portion of the actuator 70 is located in a very protected area of the gun so that nothing will be likely to impact the actuator 70 if the gun is dropped. Note particularly that the rearwardly extending pistol grip 6 and the adjacent downwardly extending shoulder stock 12 will combine to protect the actuator 70 from accidentally being touched. The actuator 70 is formed with a shoulder 90 which contacts the shoulder 80, 80' on the lock 68, as will be shown more clearly hereinafter.

Figure 4:
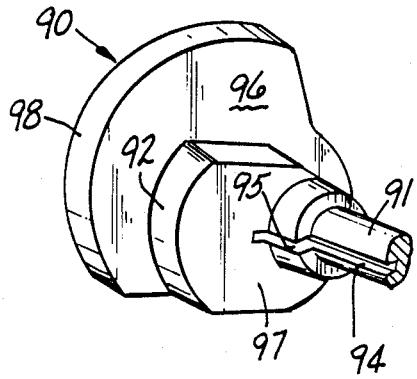
FIG. 4 is a perspective view of the manual safety locking mechanisms.
Figure 5:
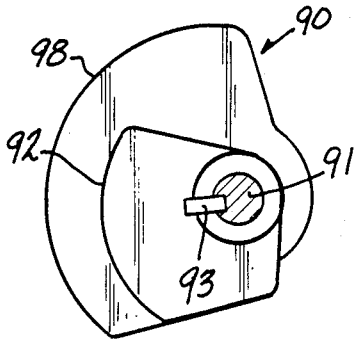
FIG. 5 is a plan view of the manual safety as viewed along its axis of rotation.
Figure 6:
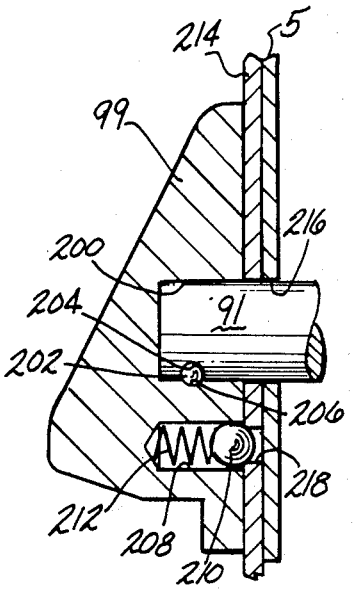
FIG. 6 is a fragmented sectional view of the dial part of the manual safety.

Referring now to FIGS. 4–6, there are shown details of the manual safety/selector assembly 18. The assembly 18 includes a body 90 which is mounted on a spindle 91. A key 93 fits into slots 94 and 95 in the body 90 and spindle 91 respectively, so that rotation of the spindle 91 results in concurrent rotation of the body 90. The body 90 has a first step 96 and a second step 97. The first step 96 has a curved perimeter stop surface 98 which engages the safety stop surface 62 on the sear 48, as will be set forth in greater detail hereinafter. The second step 97 has a curved perimeter stop surface 92 which engages the bridge 38 on the connector 34, as will be set forth hereinafter in greater detail. The stop surfaces 92 and 98 are concentric about the spindle 91. As shown in FIG. 6, the spindle 91 is connected to a dial 99 which is disposed on the exterior of the gun, and which dial 99 is the part of the safety/selector 18 which is manipulated by one to select the operating mode of the gun. The dial 99 has a blind bore 200 in which the spindle 91 is disposed. The dial 99 is keyed to the spindle 91 by latch pin 202 which seats in recesses 204 and 206 in the spindle 91 and dial 99 respectively. The dial 99 has a well 208 in which a detent ball 210 is slidably disposed. The ball 210 is biased by a spring 212 toward a detent plate 214 mounted on the trigger housing 5. The dial 99 rotates inside of an aperture 216 in the housing 5, and the detent plate 214 has three equispaced holes 218 which detent the dial 99, and the entire safety/selector assembly 18, in the several safety/selector positions. The three safety/selector positions are: "safe"; "semi automatic"; and "full automatic". Thus when the dial 99 is turned to select a firing mode, the safety/selector 18 will be detented in the chosen mode. The "safe" position is rotationally between the "semi automatic" and "full automatic" positions.

Figure 7:
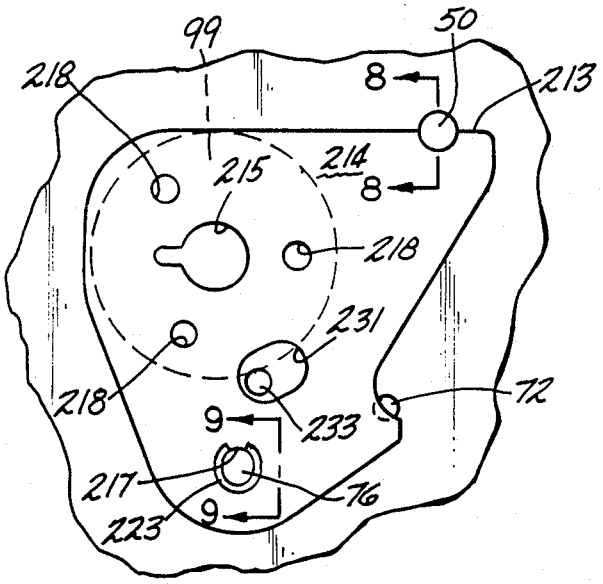
FIG. 7 is a fragmented elevational view of the side of the trigger housing showing the detent plate mounted thereon.
Figure 8:
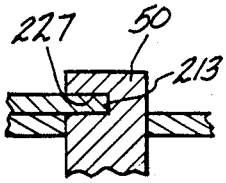
FIG. 8 is a sectional view taken along line 8—8 of FIG. 7.
Figure 9:
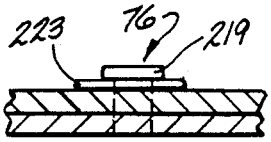
FIG. 9 is a sectional view taken along line 9—9 of FIG. 7.
Figure 10:
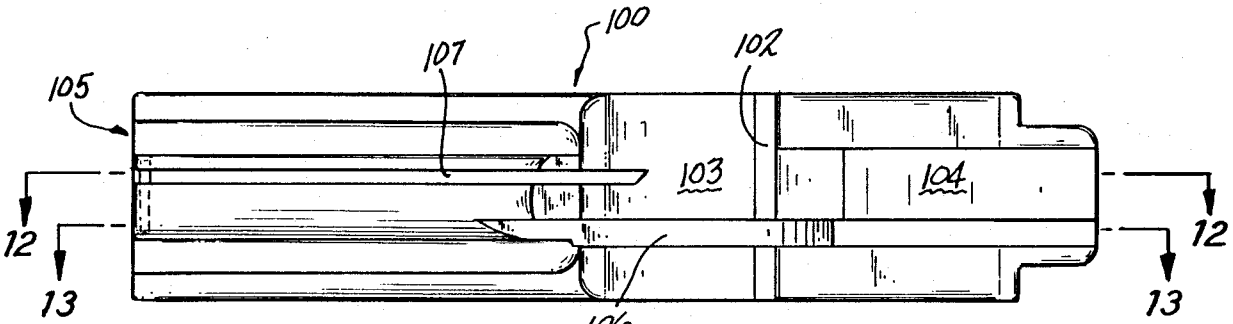
FIG. 10 is a plan view of the bottom surface of the bolt.

Referring now to FIGS. 7–9, there are shown details of the detent plate 214, with the safety/selector dial 99 being shown in phantom lines. The detent plate 214 includes an aperture 215 through which the safety/selector spindle 91 extends. It will be noted that the three detent holes 218 are spaced circumferentially about the spindle aperture 215. The plate 214 has a hole 217 through which the lock spring pin 76 extends from the trigger housing 5. The plate 214 overlies the lock pivot pin 72 which is mounted in the trigger housing 5, thereby holding the pin 72 in place on the gun. The upper edge 213 of the plate 214 extends into a slot 227 in the sear pivot pin 50 mounted in the trigger housing, thereby holding the pin 50 in place and also preventing the pin 50 from rotating in the trigger housing 5. This ensures that the cuts 51 will remain properly aligned to receive the arms 220 of the stock 12. An elongated slot 231 is formed in the plate 214 and a pin 233 mounted in the trigger housing 5 projects through the slot 231. It will be noted that the pin 233 is partially overlain by the safety/selector dial 99. The pins 72 and 50 can be removed from the trigger housing 5 by first removing the locking ring 223 from the pin 76. The pin 76 can then be pulled out of the trigger housing 5, and the plate 214 can then be rotated in the clockwise direction about the spindle 91 to the extent permitted by the pin 233 and slot 231. The pivotal movement frees the pins 72 and 50 from engagement with the plate 214 so that the pins 72 and 50 can be removed from the trigger housing.

Referring now to FIGS. 10–13, there are shown details of the bolt 100. On the bottom surface of the bolt 100 there is formed a transverse sear-engaging shoulder 102. Muzzleward of the shoulder 102 is a recess 103 and breechward of the shoulder 102 is an inclined ramp 104. The numeral 105 denotes the muzzleward end of the bolt 100. A first slot 106 is formed in the bottom of the bolt 100 to receive the connector finger 42, as will be described in greater detail hereinafter. A second slot 107 is also formed in the bottom of the bolt 100 to receive a cartridge ejector, as will be explained in greater detail hereinafter.

Figure 11:
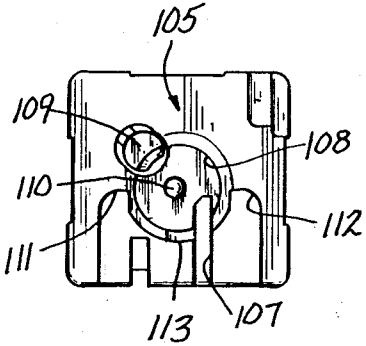
FIG. 11 is an elevational view of the front face of the bolt.

FIG. 11 shows the front, or muzzleward, face 105 of the bolt 100. A cartridge case-engaging recess 108 is formed on the bolt face 105, and a claw extractor 109 is disposed on the periphery of the recess 108. A firing pin projection 110 is positioned in the center of the recess 108. The bolt 100 has lateral recesses 111 and 112 which flank a central cartridge pickup boss 113 which sweeps across the mouth of the magazine as the bolt 100 moves from its cocked position to its firing position to pick a cartridge out of the magazine and move the cartridge into the firing chamber of the gun.

Figure 12:
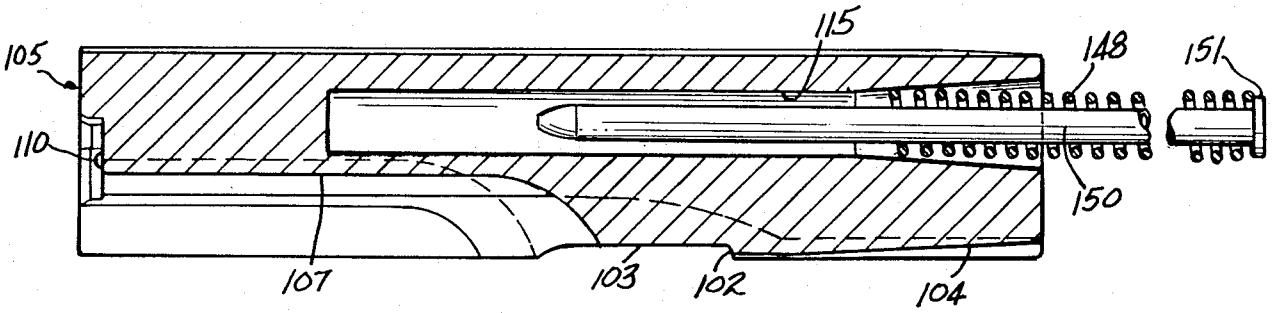
FIG. 12 is a sectional view taken along line 12—12 of FIG. 10.

As shown in FIG. 12, the ejector slot 107 extends back into the bolt 100, where it curves down into the recess 103. The bolt 100 also includes a blind bore 115 formed therein in which a bolt spring 148 and a spring guide rod 150 extend. The guide rod 150 has a flange 151 which engages the end of the spring 148. When the bolt 100 is in its cocked position, the guide rod 150 extends into the bore 115 to the extent shown in FIG. 12.

Figure 13:
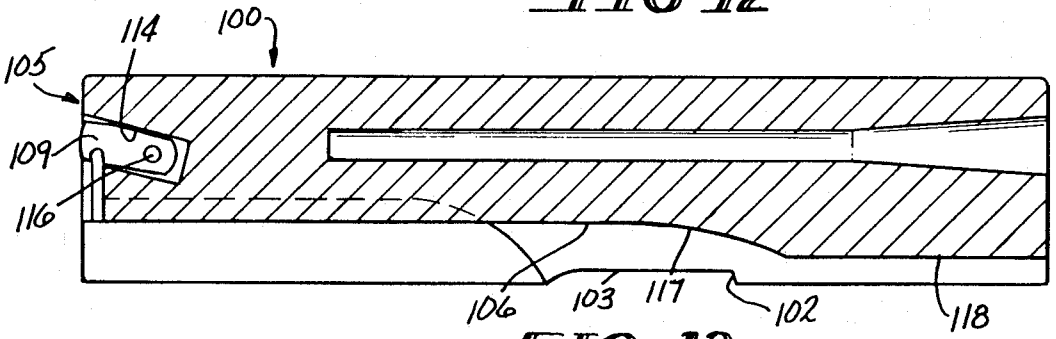
FIG. 13 is a sectional view taken along line 13—13 of FIG. 10.

As seen in FIG. 13, the extractor 109 is disposed in a bore 114 in the bolt face 105, the extractor 109 being held in place by a pin 116 which extends laterally through the bolt 100. The connector finger slot 106 extends straight back from the bolt face 105 to a downwardly curved camming ramp 117, and thence to a terminal straight recessed part 118.

Figure 14:
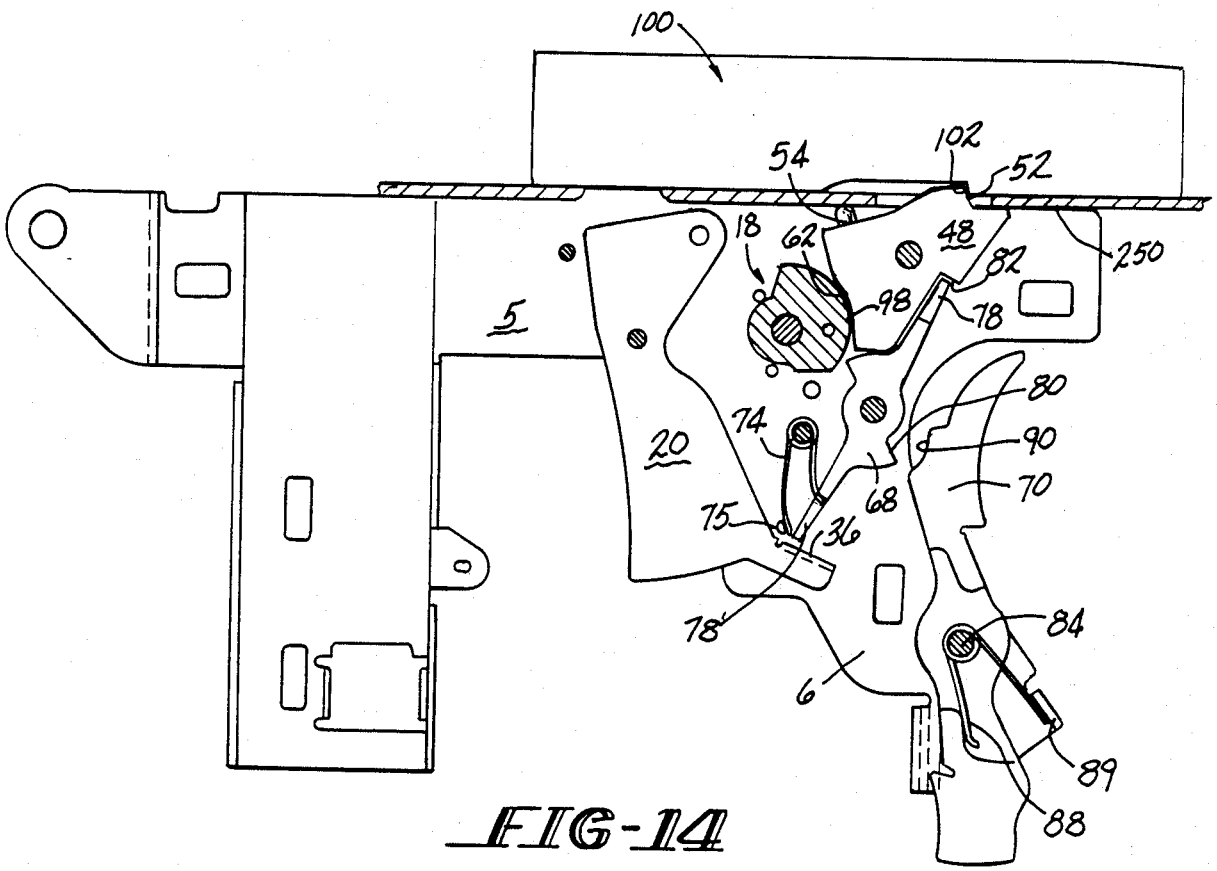
FIGS. 14–21 show sequentially how the firing mechanism operates in the various firing modes as well as the safe modes.

Referring now to FIG. 14, the firing mechanism is shown, with certain parts omitted for clarity, as it appears when the gun is at full safe, i.e. when the manual safety is set on "safe", and when the pistol grip is not being squeezed so that the pistol grip safety is also on "safe". The bolt 100 is shown in its cocked position wherein it is retained by the sear shoulder 52 engaging the complimentary shoulder 102 on the bottom face of the bolt 100. The sear lip 53 limits the extent of counter clockwise movement of the sear 48 by engaging the bottom of the receiver floor 250. The grip safety lock 68 is biased by the spring 74 in the counterclockwise direction so that the lock finger 78 engages the sear recess 82 so that the sear 48 cannot rotate out of the bolt-engaging position shown. It will be noted that one leg of the spring 74 engages a stop pin 75 in the pistol grip 6. With the grip safety in the "safe" condition, the other finger 78' on the lock 68 is positioned closely adjacent to the trigger bridge 36 so that the trigger 20 cannot be pulled.

The spring 88 biases the grip safety actuator 70 in the clockwise direction about the pin 84 so that the shoulder 90 on the actuator 70 is somewhat offset from the shoulder 80 on the lock 68. It will be noted that one leg of the spring 88 engages a tab 89 on the pistol grip 6. The manually operated firing mode safety/selector 18 is rotatably positioned in its "safe" position wherein the sear safety stop surface 62 is engaged by the complimentary safety stop 98 on the safety/selector 18 to provide an additional restriction preventing the sear 48 from rotating from the bolt latching position shown in FIG. 10. As previously noted the safety/selector is detented in the "safe" position shown in FIG. 14.

Figure 15:
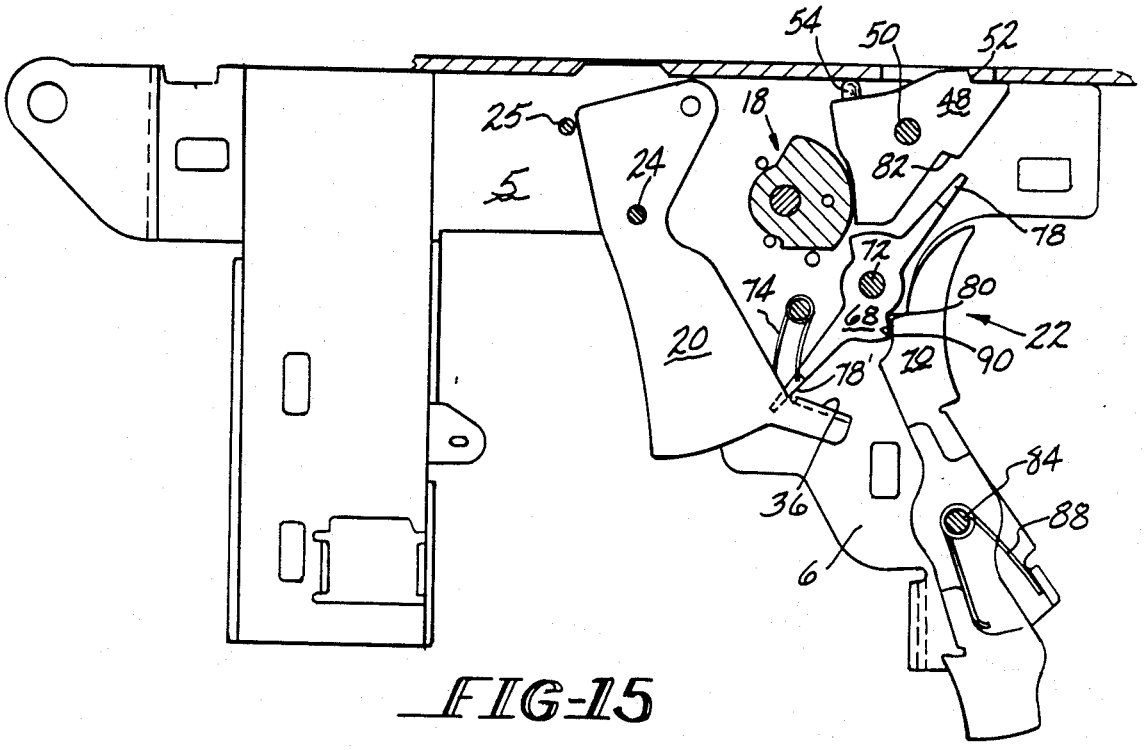

FIG. 15 shows the relative positions of the various components of FIG. 14 when the grip safety 22 and trigger 20 are squeezed, but the safety/selector is left in the "safe" position. When one grasps the pistol grip 6 and squeezes the trigger 20, the actuator 70 pivots about the pin 84 against the bias of the spring 88 toward the lock 68 until the shoulders 90 and 80 are brought into contact with each other. Continued pivotal movement of the actuator 70 causes the lock 68 to pivot in the clockwise direction about the pin 72 and against the bias of the spring 74 causing the finger 78 to disengage from the sear recess 82. At the same time, the lock finger 78' moves past the trigger bridge 36 so that the trigger 20 can be pulled. in FIG. 15, the trigger 20 is shown rotated about the pivot pin 24 after having been pulled. A stop pin 25 in the trigger housing 5 limits the extent of pivotal movement that the trigger 20 undergoes when pulled to fire the gun. It will be noted from FIG. 15 that when the grip safety 22 has been neutralized and the trigger 20 has been pulled, the grip safety 22 cannot return to its "safe" position, as shown in FIG. 14, so long as the trigger 20 stays pulled. This is because the trigger bridge 36 will block counterclockwise movement of the lock 68 due to the position of the finger 78'. This blocking function of the trigger bridge 36 is independent of the position of the actuator 70. Thus, if vibration of the gun during any firing mode thereof should cause the squeezing force applied to the actuator 70 to be interrupted, the gun will continue to fire in the selected mode so long as the trigger continues to be pulled. Thus, unintentional interruption of a "full auto" firing mode will not result from vibration of the gun so long as the trigger is pulled. It will be noted, however, that despite the pistol grip safety 22 having been neutralized, and the trigger 20 having been pulled, the gun will still not fire because the safety/selector 18 still blocks rotational movement of the sear 48 about the pin 50. It will be appreciated that once the safety/selector 18 has been rotated out of its "safe" position and into one of its firing mode selection positions, then the gun can be fired.

Figure 16:
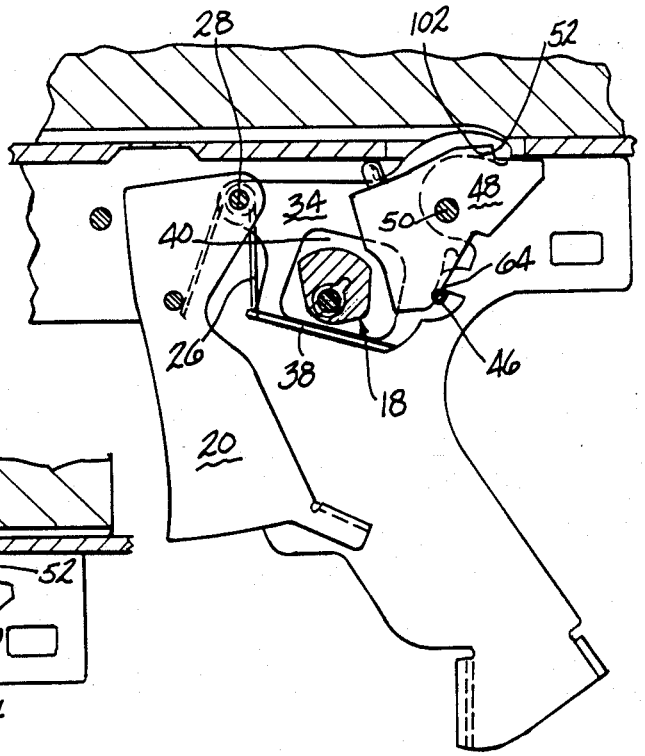

Referring now to FIG. 16, the relative positions of the trigger 20, the connector 34 and the sear 48 are shown when the trigger 20 has not been pulled. The selector 18 is shown in the single shot/semi automatic rotational position. The spring 26 engages the trigger 20 on one hand and engages the bridge portion 38 of the connector 34 on the other hand. Thus, the trigger 20 is biased about the pin 24 in clockwise direction by the spring 26, and the connector 34 is biased about the pin 28 in a counterclockwise direction. It will be understood that the safety/selector 18 extends through the window 40 in the connector 34 and does not affect the connector 34, so that the selector 18 does not positively influence operation of the connector 34 or sear 48, as will be shown hereinafter in FIGS. 16–19, while in this mode. The sear pin 64 is disposed in the notch step 46 in the connector 34 so that the connector 34 is operably connected to the sear 48. It will be understood that the sear shoulder 52 is in contact with the bolt shoulder 102 (shown in phantom) so that the bolt 100 is held in its cocked position when the components are in the position shown in FIG. 16.

Figure 17:
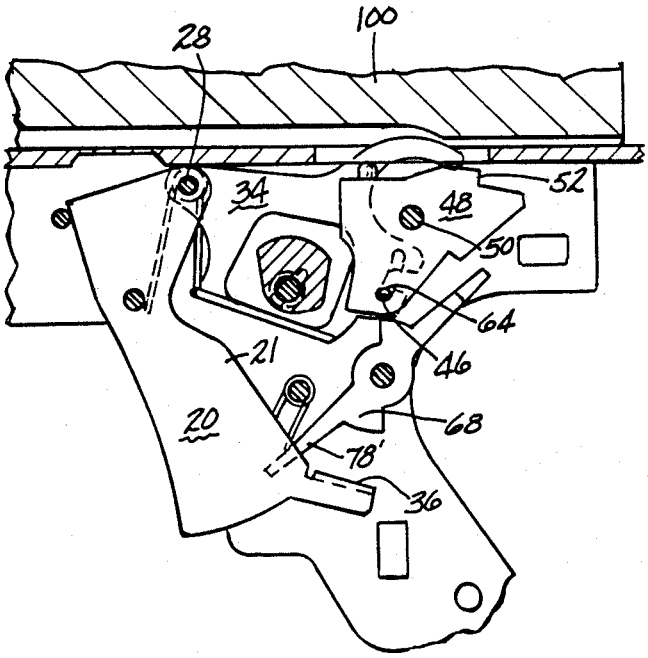

Referring to FIG. 17, the firing mechanism is shown when the trigger 20 has been pulled. When the trigger 20 is pulled, the resultant movement of the pin 28 draws the connector 34 to the left, as shown in FIG. 17, whereby the connector notch step 46 is also moved to the left. The sear pin 64 is thus pulled to the left causing the sear 48 to pivot in the clockwise direction. The sear shoulder 52 is thereby moved out of engagement with the bolt 100 so that the bolt is free to move to its fired position. As previously noted, once the grip safety has been actuated, the lock finger 78' is between the sides 21 of the trigger 20 so that the trigger bridge 36 blocks the lock 68 from pivoting back into engagement with the sear 48.

Figure 18:
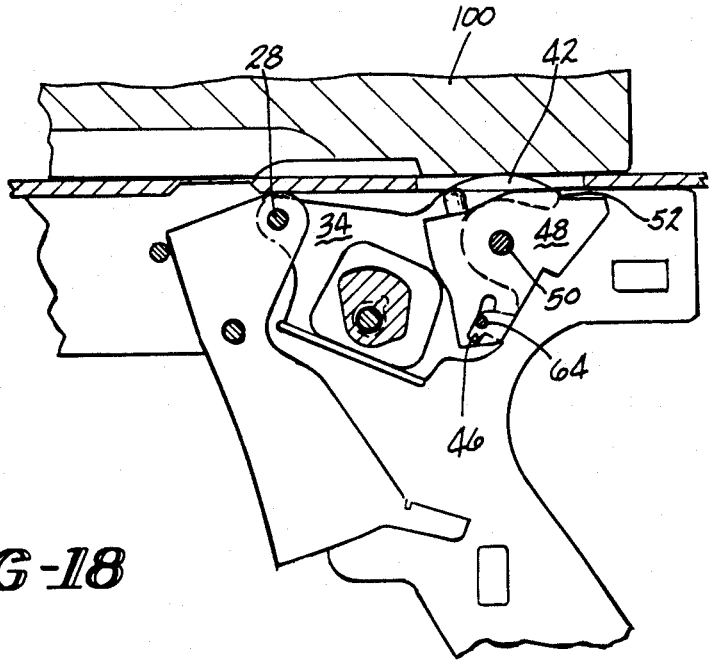

FIG. 18 shows the condition of the firing mechanism just after the bolt 100 has begun its muzzleward movement after being released by the sear 48. As the bolt 100 begins to move muzzleward, the bolt 100 overrides the connector finger 42 causing the connector 34 to pivot downwardly about the pin 28. This causes the connector step 46 to move out of engagement with the sear pin 64, thus allowing the sear 48 to pivot counterclockwise about the pin 50 so that the sear shoulder 52 can return back up to its engaging position. As shown in FIG. 18, however, the sear 48 is still pivoted downwardly since the bolt 100 has not yet moved far enough toward the firing position.

Figure 19:
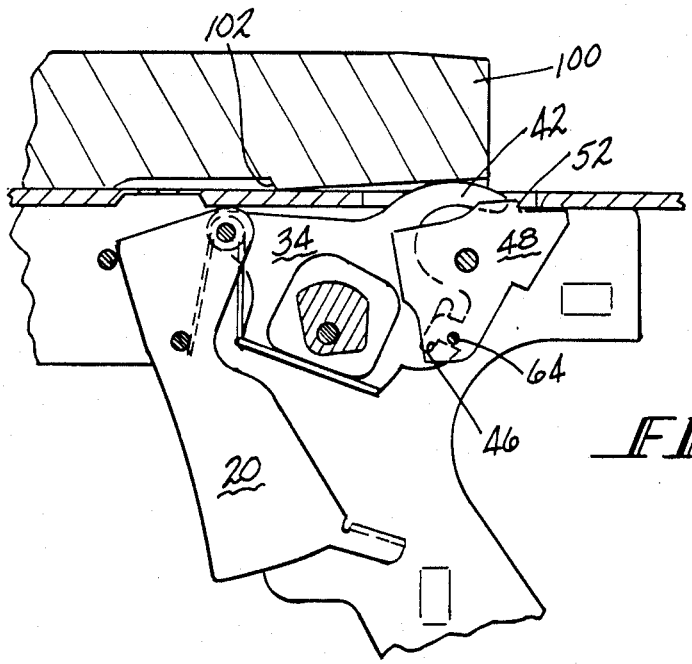

FIG. 19 shows the bolt 100 after it has fired a cartridge and is returning back to the cocked position. The sear 48 has pivoted up to its bolt-engaging position and the connector 34 has also pivoted up to its sear-engaging position. The bolt shoulder 102 is still muzzleward of the sear shoulder 52. As the bolt 100 continues to move breechward it will override the connector finger 42 causing the connector 34 to momentarily deflect downwardly, and the bolt will also override the sear 48 also causing it to momentarily deflect downwardly. Once the clearance recesses in the underside of the bolt 100 are in place, the connector 34 and the sear 48 will pop back up and the bolt 100 will be re-engaged and held by the sear 48. It will be noted that the connector step 46 cannot engage the sear pin 64 as long as the trigger 20 stays pulled. Thus, one must release the trigger 20 before the gun can be fired again. This mode is the semi automatic mode.

Figure 20:
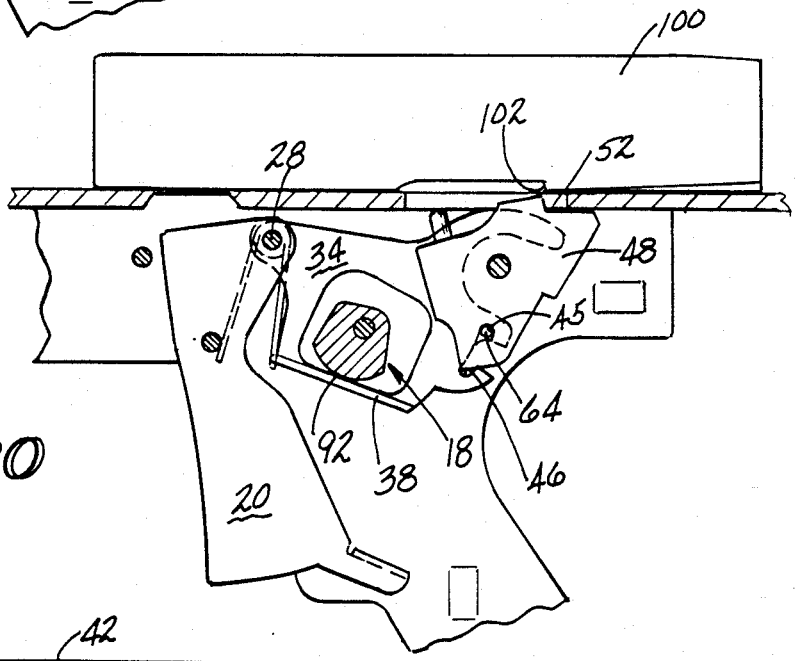
Figure 21:
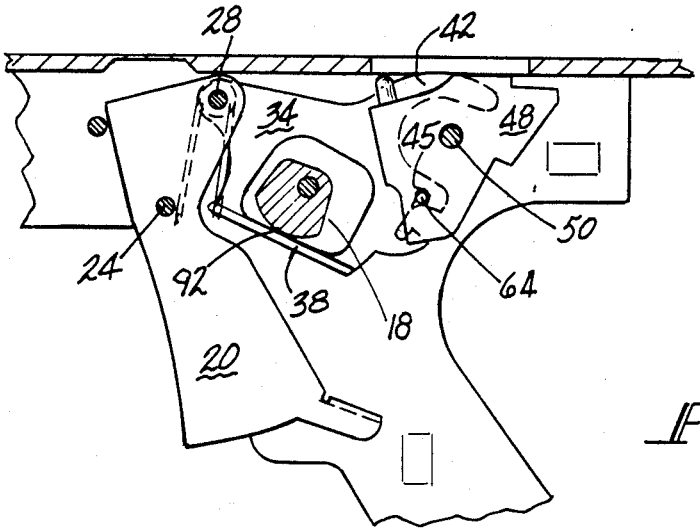

FIG. 20 shows the respective positions of the pertinent firing mechanism components when the selector 18 has been rotated to the full automatic firing mode position. In this position, the stop surface 92 on the selector 18 engages the connector bridge 38 thereby causing the connector 34 to pivot clockwise about the pin 28. This pivoting movement of the connector 34 moves the connector step 46 downwardly away from the sear pin 64 and also moves the step 45 into engagement with the sear pin 64. This pivotal movement does not affect the sear 48 however, and the sear shoulder 52 remains in engagement with the bolt shoulder 102. It will be noted that the trigger 20 is not pulled in the condition illustrated in FIG. 20. In FIG. 21, the condition of the components is shown when the trigger 20 has been pulled to fire the gun in the fully automatic mode. When the trigger 20 is pulled, it rotates about the pin 24 which drags the pin 28 and the connector 34 to the left, as shown in FIG. 21. This movement of the connector 34 causes the connector bridge 38 to slide along the stop surface 92 of the selector 18. When the connector 34 pivots, the connector step 45 moves against the sear pin 64 causing the sear 48 to pivot about the pin 50 in the clockwise direction moving the sear shoulder 52 out of engagement with the bolt 100 thereby allowing the latter to move to its firing position. The connector finger 42 is offset downwardly so that the bolt, moving reciprocally in the receiver, can no longer contact the connector finger 42. It will be appreciated that the sear 48 will be rendered unable to reengage the bolt so long as the trigger 20 is being pulled when the selector 18 is in its fully automatic position, shown in FIGS. 20 and 21. The bolt will thus be able to freely reciprocate back and forth in the receiver until the last round in the magazine is fired.

Figure 22:
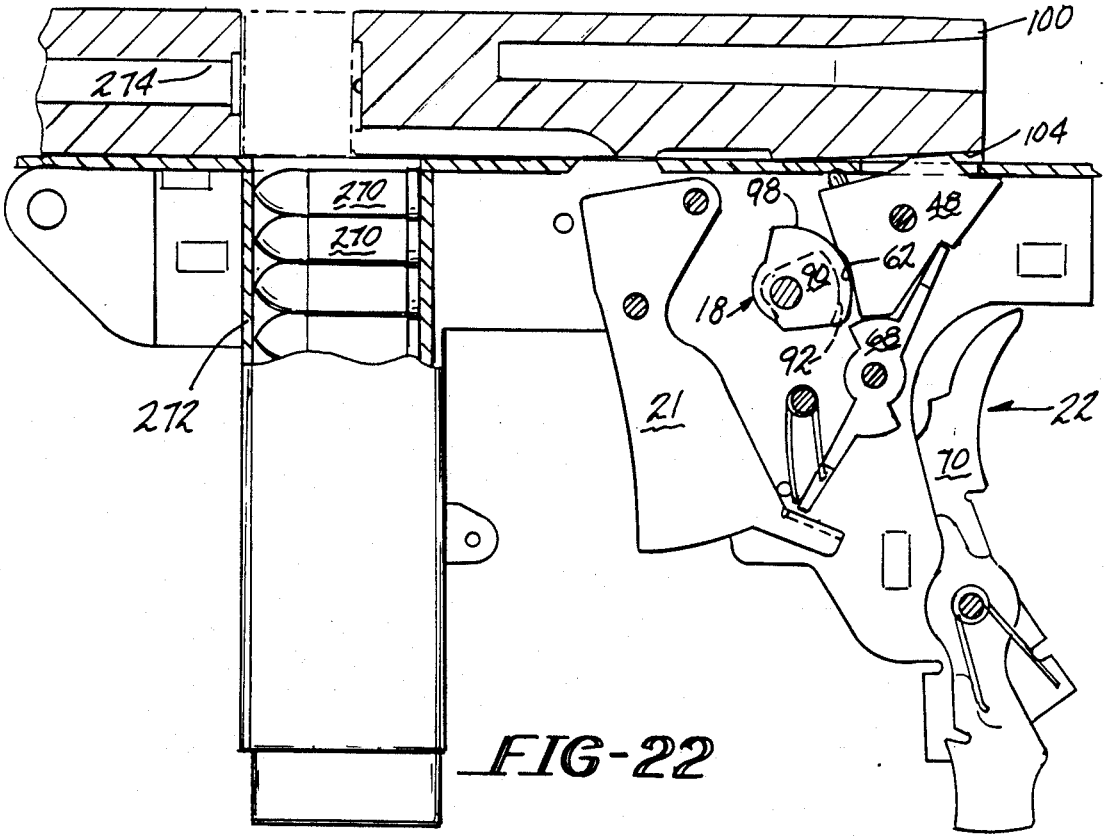
FIG. 22 is a view similar to FIGS. 14–21, but showing the bolt of the gun locked in an uncockable position when the grip safety is "on"

Referring now to FIG. 22, the bolt 100 is shown in a forward position with the safeties 18 and 22 both being in position to lock the sear 48 in its bolt-engaging position. The firing position of the bolt is shown in phantom lines. It will be noted that the bolt 100 can be pulled backward only until the ramp 104 engages the sear 48, which cannot pivot down because of engagement by the grip safety lock 78. The face of the bolt 100 cannot move backward far enough to pick up a round of ammunition 270 from the magazine 272, but it will move back enough to enable one to see whether there is a round of ammunition in the firing chamber 274. It will be appreciated that if the gun is accidentally dropped with the bolt in the fired position as shown in FIG. 22, it cannot accidentally cock itself and pick up a cartridge and fire it. Thus the gun cannot accidentally fire if dropped when in the breech-closed condition. Thus, whether the bolt is in the forward (fired) position or in the rearward (cocked) position, the blocked sear acts as a safety mechanism by limiting movement of the bolt.

Figure 25:
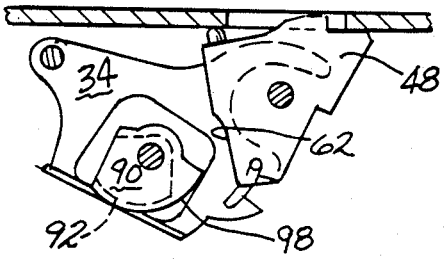
FIGS. 23–25 are similar to FIGS. 14–21 but show sequentially the positions of the manual safety as it is turned from the "safe" position to the "fully automatic" position.
Figure 23:
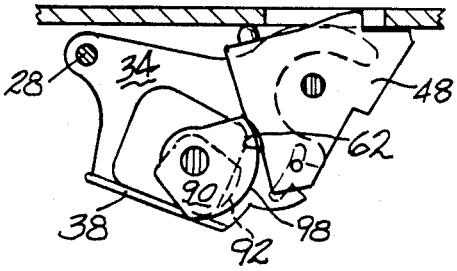
Figure 24:
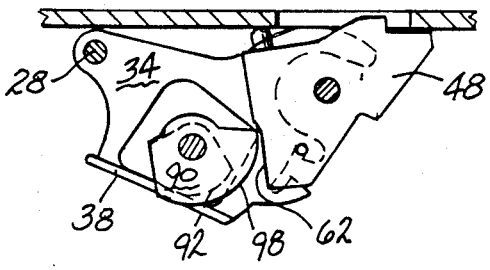

FIGS. 22 and 23–25 show how, when changing the operating mode of the gun from "safe" to "full automatic", the sear 48 remains blocked until all pivotal movement of the connector 34 has stopped. As shown in FIG. 22, the gun is in its "safe" mode with the stop surface 98 on the body 90 engaging the surface 62 on the sear 48. The inner concentric surface 92 on the body 90 also faces the sear 48. To change to the "full automatic" mode, the body 90 is rotated in the clockwise direction so as to move the surface 92 toward the bridge 38 on the connector 34 as shown in FIG. 23. As the surface 92 moves toward the bridge 38, the connector 34 begins to pivot downwardly about the pin 28. As this pivotal movement occurs, the stop surface 98 remains adjacent to the sear surface 62 thus preventing the sear 48 from moving as will be noted in FIG. 23. This blocking of the sear surface 62 by the stop surface 98 continues until the inner curved surface 92 actually comes into contact with the connector bridge 38, as will be seen in FIG. 24. Once the curved surface 92 engages the connector bridge 38, further pivotal movement of the connector will stop, since the axis of rotation of the body 90 is the center of the arc forming the surface 92. After such engagement between the surface 92 and the connector bridge is achieved, further rotation of the body 90 to the detented "full automatic" position will move the stop surface 98 away from the sear surface 62 so that the gun can be fired as shown in FIG. 25. In this manner, any tendency of the connector 34 to move the sear 48 as the connector 34 itself is being moved, will be positivly resisted until movement of the connector 34 stops. This is a very important safety feature of the gun which prevents it from accidentally firing when the firing mode is being changed.

Figure 26:
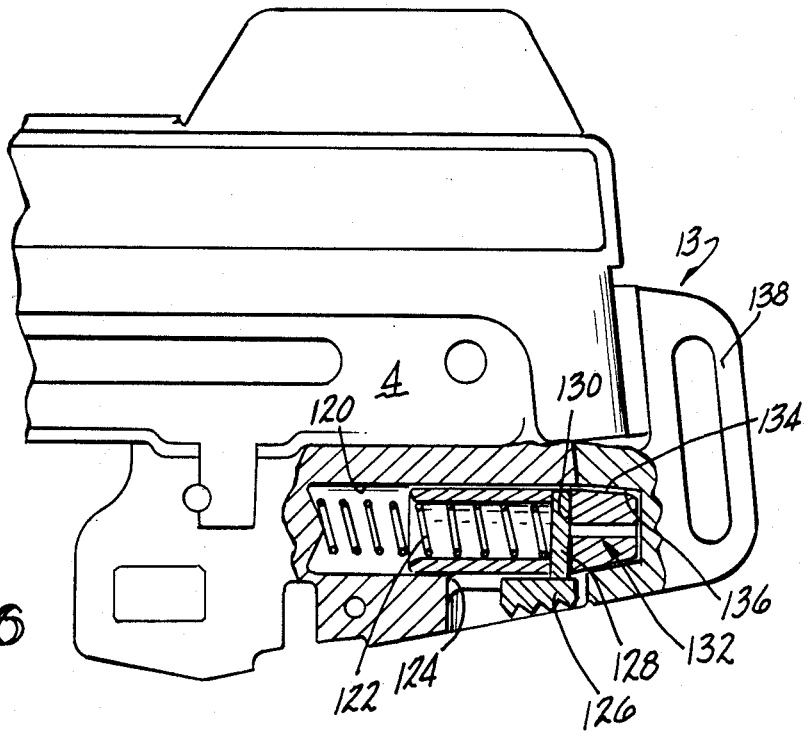
FIG. 26 is a fragmented side elevational view, partially in section, showing details of the receiver cover latch.

Referring now to FIG. 26, details of the receiver cover latch are shown. At the butt end of the receiver 4, there is a well 120 in which a coil spring 122 is positioned. A slot 124 is formed in the bottom of the receiver 4 and a finger latch 126 is positioned in the slot 124. A pin 128 extends upwardly from the latch 126 into a bore 130 formed in a locking lug 132 slidably disposed in the bore 120. The locking lug 132 is biased in the buttward direction by the spring 122. The lug 132 includes a tapered post 134 which projects from the butt end of the receiver 4. The receiver cover 13 has a tapered cavity 136 formed therein into which the post 134 rests. The complimentary tapers of the post 134 and cavity 136 ensure that the cover 13 will always be held snugly in place and will not rattle on the receiver 4. In order to release the cover 13 and allow it to be moved to its open position, the latch 126 is manually pushed muzzleward. This causes the post 134 to move out of the cavity 136 whereby the cover 13 can be lifted upwardly away from the receiver 4 by grasping the cover loop 138 and pulling up.

Figure 27:
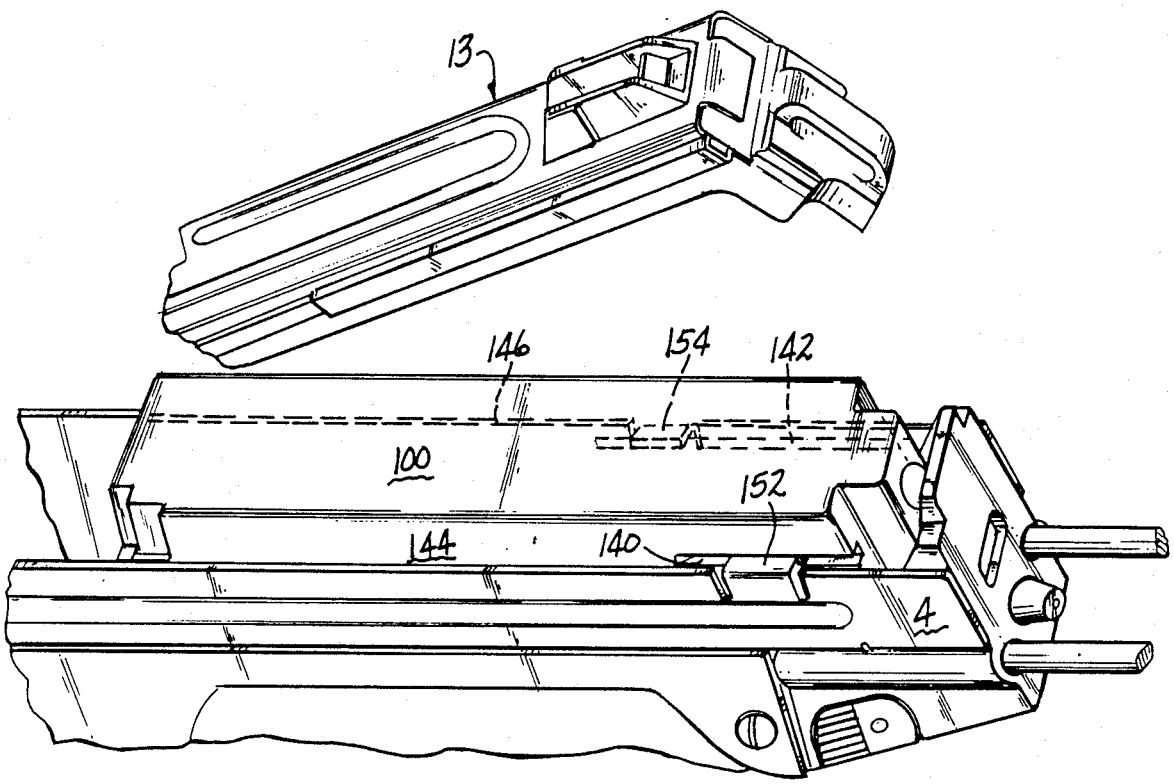
FIG. 27 is a fragmented perspective view of the butt end of the gun with the receiver cover being open and the bolt in its cocked position.
Figure 28:
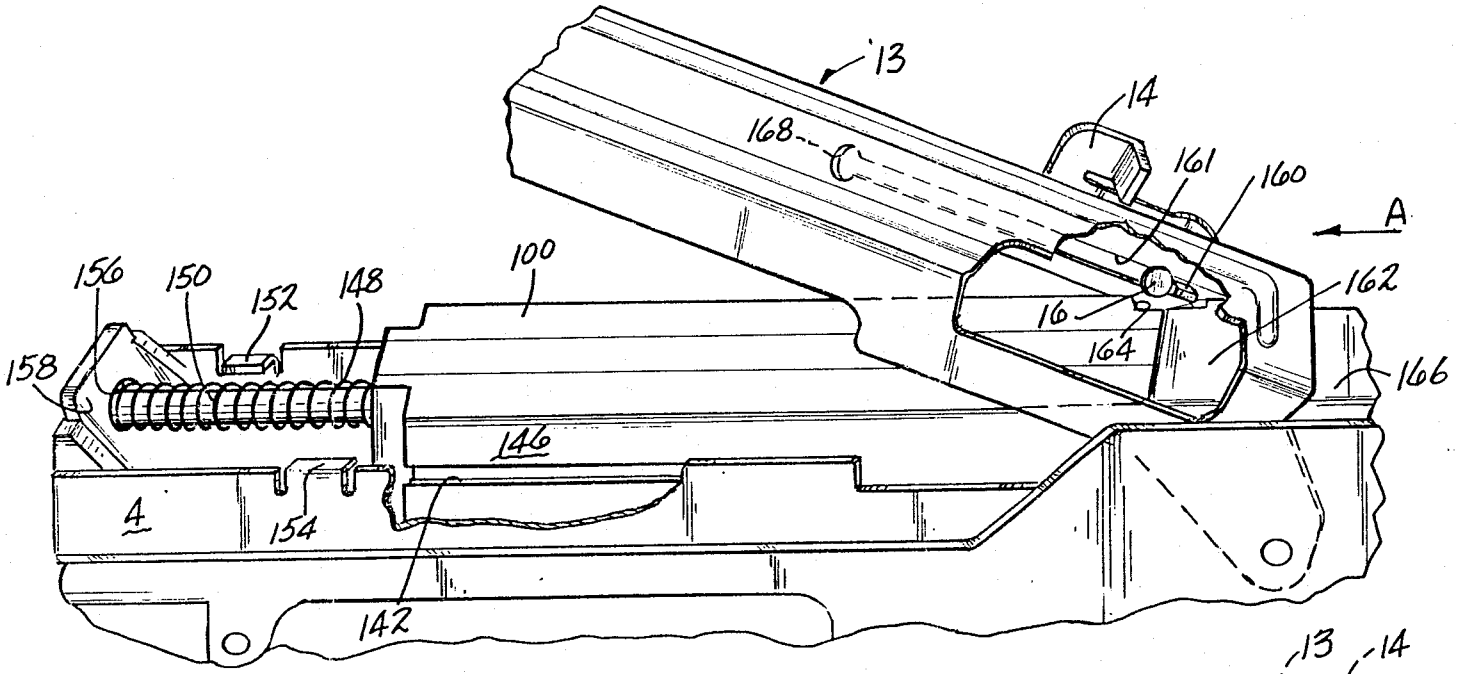
FIG. 28 is a fragmented perspective view similar to FIG. 27 but from the opposite side of the gun, showing the bolt in its fired position and showing how the cocking slide detents the receiver cover in its open position.

FIGS. 27 and 28 show the cover 13 in its upwardly pivoted open position with the bolt 100 being in its cocked position in FIG. 27, and in its fired position in FIG. 28. The bolt 100 has grooves 140 and 142 formed in its side walls 144 and 146 respectively. It will be understood that the bolt spring 148 which is mounted on the spring guide rod 150 is biasing the bolt 100 toward its muzzleward fired position, but that the sear is holding the bolt 100 in its cocked position. There are a pair of inwardly bent tabs 152 and 154 formed on the sides of the receiver 4, and the tabs 152 and 154 are disposed in the bolt grooves 140 and 142 respectively when the bolt 100 is in the cocked position. These tabs 152 and 154 prevent the bolt 100 from moving upwardly away from the receiver 4 when the cover 13 is opened. Thus, the bolt 100 will be held down against the sear when the bolt 100 is cocked and the cover 13 is opened. The gun will thus not accidently fire if the cover 13 is opened when the bolt 100 is cocked. This is a major safety feature which is not found in similiar sub machine guns of the prior art.

As shown in FIG. 28, when the bolt 100 is in the fired position and the cover 13 is opened, the grooves 140 and 142 are muzzleward of the tabs 152 and 154. The flange 151 on the spring guide rod 150 seats in a recess 156 in the breechward wall 158 of the receiver 4. The rod 150 can be removed from the receiver 4 by pushing the rod 150 muzzleward to compress the spring 148 sufficiently to clear the rod 150 from the recess 156. Once the rod 150 and spring 148 have been removed from the receiver 4, the bolt 100 can be lifted upwardly out of the receiver 4. As previously noted, the cocking slide 14 is spring biased in the muzzleward direction so that it will be biased to the position shown in FIG. 28 when the cover 13 is opened. A bolt engaging finger 160 on the cocking slide 14 projects inwardly through a slot 161 in the cover 13 muzzleward of the pin 16. The finger 160 engages a shoulder 164 on the bolt 100 so that the bolt 100 will be pulled to its cocked position when the slide 14 is moved in the direction of the arrow A. When the cover 13 is opened, the finger 160 is biased against the muzzleward end of the slot 161 so that the finger 160 overrides a ridge 162 on the upper surface of the barrel housing part 166 of the receiver 4.

Figure 29:
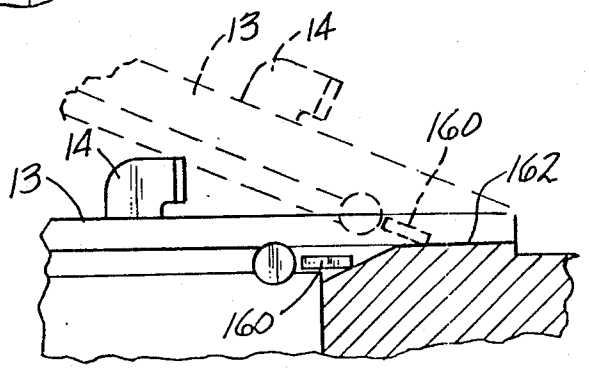
FIG. 29 is a fragmented sectional view, partially in phantom, showing further details of the cover detenting portion of the cocking slide.

This engagement between the finger 160 and ridge 162 holds the cover 13 in its open position, and prevents it from being closed unless the slide 14 is moved the direction of the arrow A. Thus, take down of the gun can be accomplished using both hands. The slide 14 can be disconnected from the cover 13 by moving the slide 14 in the direction of the arrow A until the pin 16 aligns with an enlargement 168 in the breechward end of the slot 161. With such alignment, the pin 16 can be pulled free of the cover 13 and slide 14. The slide 14 can then be withdrawn from the pocket 15 and disconected from the cover 13. FIG. 29 illustrates the manner in which the slide 14, by reason of the finger 160 overriding the ridge 162, holds the cover 13 in its open position, the cover 13 being shown in solid lines in its closed position, and in phantom lines in its open position.

Figure 30:
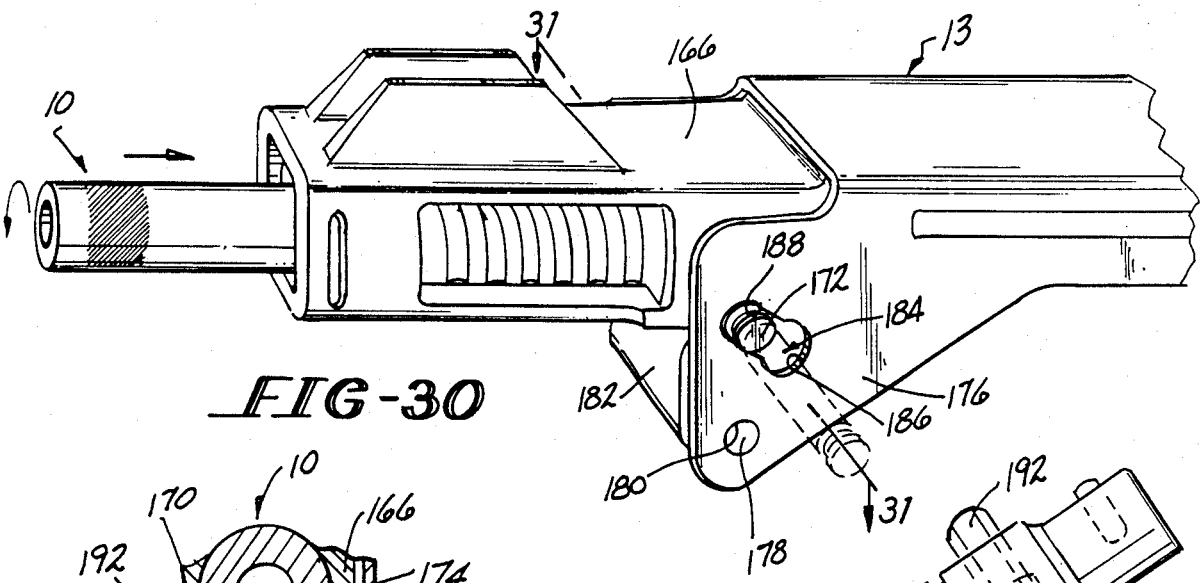
FIG. 30 is a fragmented perspective view of the muzzle end of the gun showing the barrel and the muzzelward end of the receiver housing and receiver cover.
Figure 31:
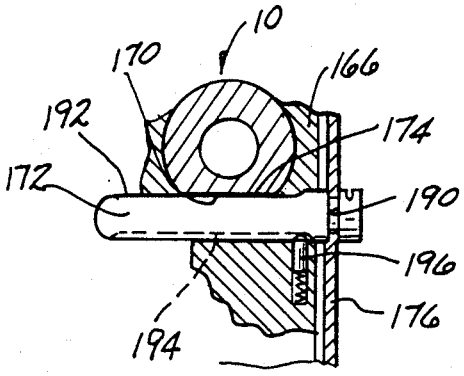
FIG. 31 is a sectional view taken along line 31—31 of FIG. 30.
Figure 32:
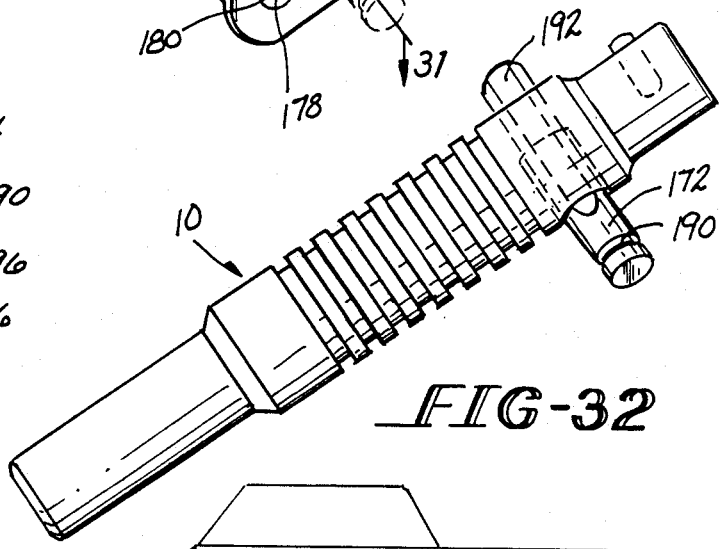
FIG. 32 is a perspective view of the barrel and barrel retention pin.

FIGS. 30–32 show the manner in which the barrel 10 is removably connected to the barrel housing part 166 of the receiver. The barrel 10 is telescoped into the barrel housing part 166 of the receiver. The barrel 10 includes a flat 170, and a pin 172 is slidably disposed in a passage 174 drilled in the barrel housing 166. The cover 13 has a pair of wings 176 which flank the sides of the barrel housing 166. A pivot pin 178 extends through openings 180 in the cover wings 176 and through an aligned passage (not shown) in a boss 182 depending from the barrel housing 166. The pin 178 is the pivot for movement of the cover 13 to and from its open and closed positions. Above the openings 180, there is formed a compound hole 184 in one of the cover wings 176. The hole 184 includes an enlarged portion 186 and an interconnected restricted portion 188. It will thus be noted that the hole 184 is shaped generally like a keyhole. The pin 172 has a circumferential slot 190 thereon in which the restricted portion 188 of the hole 184 is received when the cover 13 is in its closed position, as shown in FIG. 21. Thus, when the cover 13 is in its closed position, the pin 172 cannot be removed from the passage 174. The barrel 10 cannot, therefore, be removed from the rest of the gun when the cover 13 is closed. The pin 172 has a flat 192 which mates with the barrel flat 170 so that the pin 172 cannot be rotated out of its proper orientation in the passage 174. On the underside of the pin 172 there is formed a slot 194 which is closed at both ends, and which receives a spring biased detent 196 mounted in the barrel housing 166. The detent 196, through its engagement with the slot 194, prevents the pin 172 from being completely removed from the passage 174. In order to remove the barrel 10 from the barrel housing 166, the cover 13 is pivoted to its open position. This moves the pin slot 190 into the enlarged portion 186 of the hole 184. The pin 172 can then be withdrawn from the passage 174 until the detent 196 engages the inner end of the slot 194, whereupon the pin 172 cannot be further withdrawn. At this point, the inner end 198 of the pin 172 has cleared the flat 170 on the barrel 10, so that the barrel 10 can be removed from the housing 166.

Figure 33:
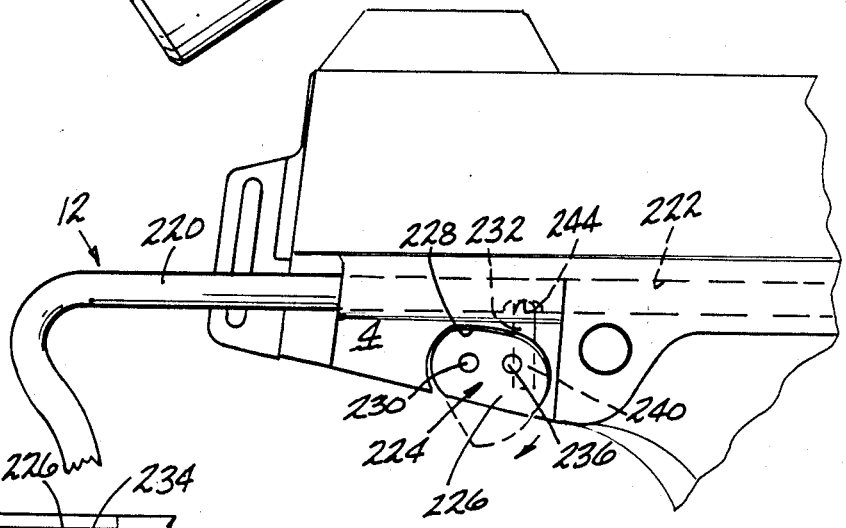
FIG. 33 is a fragmented side elevational view showing the adjustable stock latch on the gun.
Figure 34:
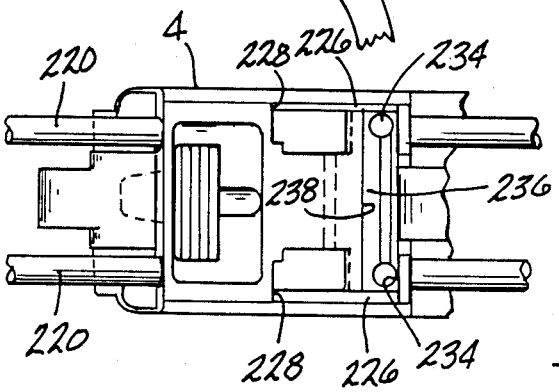
FIG. 34 is a fragmented view of the bottom of the butt end of the receiver showing details of the adjustable stock latch.

Referring now to FIGS. 33 and 34, there are shown details of the adjustable stock latch denoted generally by the numeral 224. The latch 224 includes a pair of wings 226 which are disposed in recesses 228 cut into each side of the receiver 4. The wings 226 pivot about a pin 230 which extends through the receiver 4. The stock 12 includes a pair of arms 220 which are telescoped into bores 222 formed in the receiver 4. A pair of pins 232 are slidably mounted in a pair of passages 234 which extend upwardly through the receiver 4. A connector pin 236 extends laterally through a slot 238 which opens through the bottom of the receiver 4. The connector pin 236 extends through semi-circular cuts 240 in the pins 232 so that movement of the wings 226 results in movement of the pins 232. The detent pins 232 engage recesses 244 in the stock arms 220. Each of the stock arms 220 has two axially spaced recesses 224, one of which, when engaged by the detent pins 232, holds the stock 12 in its retracted position, shown in FIGS. 1, 2 and 33, and the other of which, when engaged by the detent pins 232, holds the stock 12 in its extended position. It will be understood that the latter position allows the gun to be used as a shoulder arm. To change stock positions, the latch wings 226 are pivoted downwardly about the pins 230 thus moving the detent pins 232 through the passage 234 out of engagement with the notches 244. The stock 12 can then be moved with respect to the receiver 4 to a different position. The stock 12 is relatched by pivoting the wings 226 back to their original positions, shown in FIG. 1.

Figure 35:
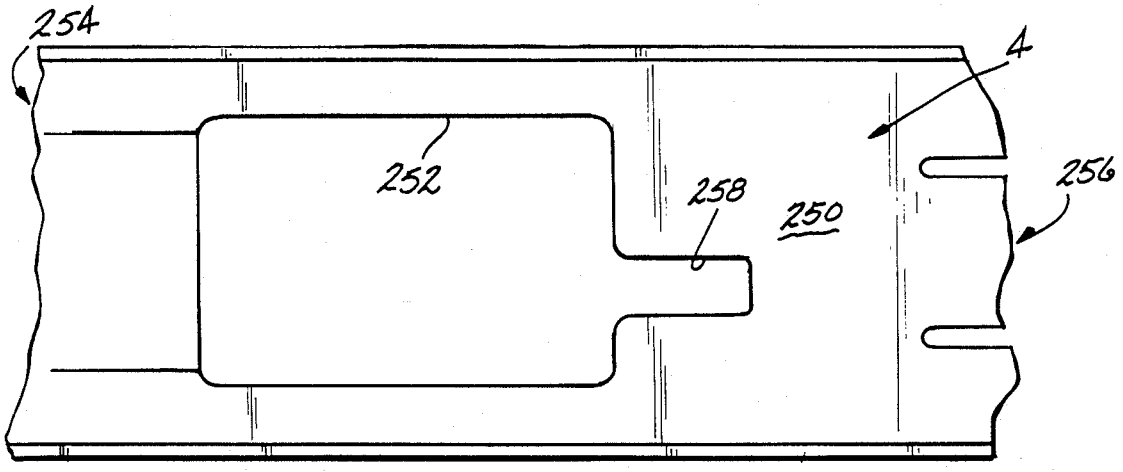
FIG. 35 is a fragmented plan view of the portion of the receiver in which the cartridges are fed and ejected.
Figure 36:
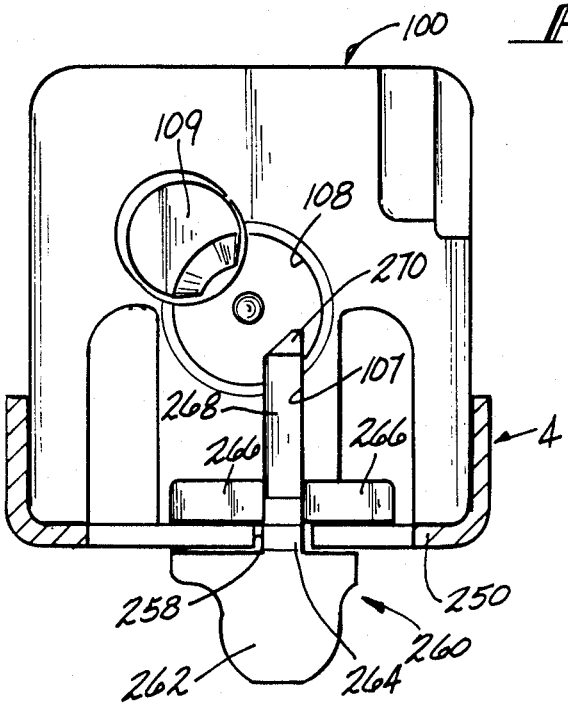
FIG. 36 is an elevational view, partly in section, of the receiver and bolt face showing the ejector in front elevation.
Figure 37:
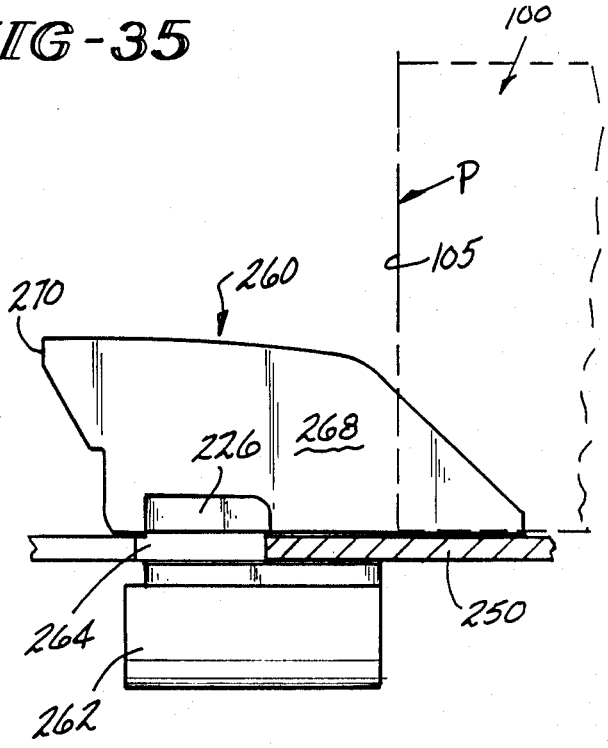
FIG. 37 is a side elevational view, partly in section, showing the ejector mounted in the receiver.

FIG. 35 is a fragmented plan view of the portion of the receiver 4 in which the cartridges are fed and ejected. In the floor 250 of the receiver 4 there is disposed a magazine window 252 through which cartridges are fed from the magazine into the gun. The numeral 254 indicates the muzzleward end of the gun and the numeral 256 indicates the breechward or butt end. A slot 258 extends brechwardly from the window 252 and opens muzzlewardly into the window 252. The slot 258 provides the mounting part of the gun which carries the floating ejector which is shown in FIGS. 36 and 37, and which is denoted generally by the numeral 260. The ejector 260 includes a keel 262 which is disposed below the receiver floor 250, and a reduced neck 264 which is received in the slot 258. It will be noted from FIG. 37 that the lateral dimension of the slot 258 is sufficiently larger than the lateral dimension of the neck 264 so that the ejector 260 can float or move laterally when it is in place in the receiver 4. This lateral flexibility ensures that the ejector will not bind in the ejector slot 107 as the bolt 100 moves back and forth between its cocked and fired positions. The ejector has a pair of lateral feet 266 which engage the receiver floor 250, and a finger 268 which extends upwardly into the ejector slot 107 in the bolt. The ejector finger 268 has a muzzlewardly projecting nose 270 which will enter the cartridge base-engaging recess 108 in the bolt 100 when the bolt moves from its firing position to its cocked position. The ejector nose 270 thus strikes the base of a cartridge being held in the recess 108 by the extractor 109, and pivots the cartridge out of the recess 108 and away from the extractor 109. The cartridge is thus ejected through the ejection port 11 in the cover 13. As shown in FIG. 37, when the bolt 100 is in its rearwardmost position after the ejection of a spent cartridge, its face 105 will be positioned in the plane P so that the bolt 100 retains its engagement with the ejector 260 through the full extent of bolt travel. This prevents misalignment of the bolt 100 and ejector 260 during operation of the gun.

It will be readily appreciated that the sub machine gun of this invention is capable of being manually set on a "safe" condition, a semi-automatic condition, and fully automatic condition by a single safety/selector assembly. The safety/selector assembly is pivotably neutral, and is detented and held into whatever position it is preset. A pivotally neutral grip safety is also provided so that the gun cannot be fired unless the grip is squeezed. The fully automatic firing mode will not be interrupted, once initiated, until the trigger is released. A pivotable receiver cover is included which is firmly latched in place over the receiver and bolt. When the cover is released and pivoted to its open position, it is held in that position by a spring-biased cocking slide. If the cover is pivoted to its open position with the bolt in a cocked position, the bolt will not move accidentally to its fired position. Also when the cover is pivoted to its open position, the barrel can then be removed from the rest of the gun. A shoulder stock which can be adjusted by manipulation of a shoulder stock latch is provided to allow the gun to be used as a shoulder arm, if desired. The gun includes an ejector which is mounted in a slot in the floor of the receiver and includes a finger which extends up into a slot in the bolt. There is sufficient lateral tolerance in the slots in which the ejector operates so as to ensure that the bolt will not bind on the ejector as the bolt reciprocates in the receiver. The gun thus provides improved safety and performance with simplified mechanisms.

While specific embodiments of features of the machine gun of this invention have been disclosed, it is not intended to limit the scope the invention otherwise than as required by the appended claims.

What is claimed is:

1. A submachine gun comprising:

a. a trigger housing having a pistol grip;

b. a receiver connected to said trigger housing;

c. a bolt reciprocally mounted in said receiver for movement between a cocked position and a fired position, and return;

d. a sear mounted in said trigger housing on a pivot pin for selectively engaging said bolt to hold the latter in said cocked position;

e. a trigger mounted in said trigger housing;

f. a one piece connector member mounted in said trigger housing for interconnecting said trigger and said sear, said connector member being pivotally mounted on said trigger, said connector member including a first catch which engages said sear when said gun is in its semi-automatic firing mode, and a second catch which engages said sear when said gun is in its fully automatic mode, and a spring disposed on a spring mounting pin for engaging said connector member for biasing the latter, with respect to said trigger, to a position wherein said first catch engages said gear; and g. a manual safety/selector member mounted in said trigger housing and movable between: a safe position wherein said safety/selector member engages said sear to prevent said sear from moving out of engagement withe said bolt; a semi-automatic position wherein said safety/selector member is free from engagement with either said sear or said connector member when said trigger is pulled to actuate the gun; and a fully automatic position wherein said safety/selector engages said connector member to lock said connector member into engagement with said sear when said trigger is pulled whereby said sear is prevented from engaging said bolt so long as said trigger remains pulled.

2. The submachine gun of claim 1 wherein said safety/selector member is mounted in said trigger housing for rotational movement about an axis which is perpendicular to the direction of movement of said bolt, said safety/selector member having a first stop surface for engaging said sear to prevent movement of the latter, and a second stop surface for engaging said connector member to lock the latter into connection with said sear, said first and second stop surfaces being both axially and rotationally offset from each other on said safety/selector member.

3. The submachine gun of claim 2 further comprising detent means for holding said safety/selector member in each of said safe, semi-automatic, and fully automatic positions.

4. The submachine gun of claim 3 wherein said detent means comprises a plate mounted on an external surface of said trigger housing, said plate having a plurality of spaced openings in it which are arranged about a central opening in said plate through which said safety/selector member extends, and said safety/selector member includes a dial portion adjacent to said plate, said dial portion carrying a spring biased detent operable to engage said spaced openings during rotation of said safety/selector member.

5. The submachine gun of claim 4 wherein said plate further engages said pivot pin and said spring mounting pin to retain said pins in said trigger housing.

6. The submachine gun of claim 5 wherein said plate is rotatable about said central opening to selectively release said pins for removal from said trigger housing.

7. The submachine gun of claim 1 wherein said safety/selector member is operable when in said fully automatic position, to pivot said connector member against bias of said spring to a position wherein said second catch engages said sear.

8. The submachine gun of claim 7 wherein said connector member includes a central window portion through which said safety/selector extends member said window portion having an edge which is engaged by said safety/selector member when the latter is in said fully automatic position.

* * * * *